US006588633B1

(12) United States Patent
Ammann

(10) Patent No.: US 6,588,633 B1
(45) Date of Patent: Jul. 8, 2003

(54) DEVICE FOR HOLDING SOCKS OR STOCKINGS IN PAIRS

(76) Inventor: Peter Ammann, Gurnigelstrasse 13, CH-3600 Thun (CH)

( * ) Notice: Subject to any disclaimer, the term of this patent is extended or adjusted under 35 U.S.C. 154(b) by 0 days.

(21) Appl. No.: 10/168,778

(22) PCT Filed: Dec. 22, 1999

(86) PCT No.: PCT/IB99/02086

§ 371 (c)(1),
(2), (4) Date: Jun. 21, 2002

(87) PCT Pub. No.: WO01/46510

PCT Pub. Date: Jun. 28, 2001

(51) Int. Cl.[7] ..... A41D 27/22
(52) U.S. Cl. ..... 223/87; 223/85
(58) Field of Search ..... 223/85, 87

(56) References Cited

U.S. PATENT DOCUMENTS 4,414,716 A 11/1983 Stastney ..... 24/3 L
5,234,139 A 8/1993 Korenstein ..... 223/85

FOREIGN PATENT DOCUMENTS

| | | | |
|---|---|---|---|
| DE | 4030120 | 3/1992 | ..... D06F/93/00 |
| DE | 4238523 | 5/1994 | ..... D06F/93/00 |
| GB | 2325955 | 9/1998 | ..... D06F/95/00 |
| WO | WO9823806 | 6/1998 | ..... D06F/55/00 |

*Primary Examiner*—Rodney M. Lindsey
*Assistant Examiner*—James G Smith
(74) *Attorney, Agent, or Firm*—Cooper & Dunham LLP; Donald S. Dowden

(57) ABSTRACT

The invention relates to a device for holding socks or stockings in pairs. The inventive device consists of a holding body (1) and a hook (2), which are joined by a predetermined breaking point (3). A slit is arranged in the holding body (1) for receiving two socks or stockings. The slit is enclosed on all sides by the holding body (1). The device is produced easily and holding the socks or stockings securely and in a caring manner.

14 Claims, 1 Drawing Sheet

DEVICE FOR HOLDING SOCKS OR STOCKINGS IN PAIRS

BACKGROUND

This application relates to a device for holding socks or stockings in pairs in accordance to the preamble of claim 1.

Such devices are used for storing socks in pairs and/or for preventing the socks from being separated during washing. For this purpose they must be of washable material, i.e. they must be able to be washed at 60° or even 95° without loosing their stability or mechanical properties.

Clamps or clamp-like fasteners have been suggested for such kind of devices so far, such as they are e.g. described in U.S. Pat. No. 4,414,716. However such clamps or fasteners are complicated in production and application and can damage the socks or stockings.

DESCRIPTION OF THE INVENTION

Hence, it is an object to provide a device of the initially mentioned type that prevents these disadvantages as possible.

This object is achieved by the device of claim 1. Hence, according to the invention the device has a holding body in which a slit is arranged for receiving both socks. The slit is enclosed on all sides by the holding body in non-openable manner, i.e. the holding body forms a non-openable loop, which extends around the whole slit.

Such a device can be produced without problems because of its simple geometry. Since the slit is enclosed on all sides, it can hold the socks securely. It does not need any teeth, corners or suchlike, which could damage the socks. The slit can extend substantially along a straight line across the holding body.

Preferably the device consists of Teflon because this material is soft, elastic, tearproof, sturdy and washable. Other soft, heat-resistant plastics are preferred likewise.

BRIEF DESCRIPTION OF THE DRAWINGS

Further embodiments, advantages and applications of the invention ensue from the dependent claims and from the now following description by reference of the figures. Thereby show:

MODE FOR CARRING OUT THE INVENTION

Figure 1:
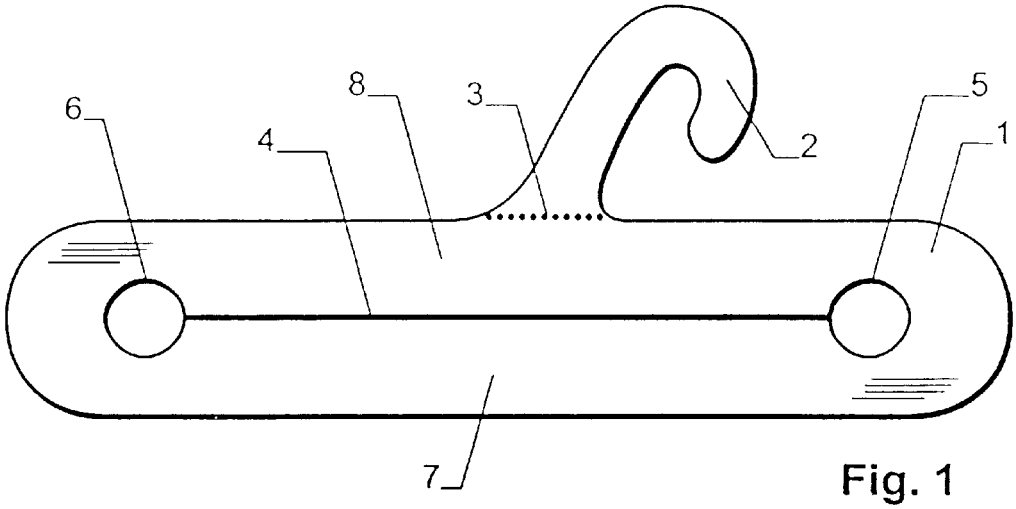
FIG. 1 a preferred embodiment of the invention.

FIG. 1 shows a device for holding socks or stockings in pairs. It comprises a holding body 1, on which a hook 2 can be arranged. The hook 2 is joined to the holding body 1 by means of a perforation 3 acting as a predetermined breaking point, such that the hook 2 can be broken off if it is not needed.

In the present embodiment the hole device consists of a heat-resistant plastic, in particular Teflon, and is produced by punching or injection molding from one piece.

The holding body 1 is designed as an elongate plate of a thickness of 1.0–2.5 mm, preferably approx. 1.5 mm, in whose longitudinal direction extends a straight slit 4. This slit is enclosed on all sides by the holding body 1. At each of its ends, the slit 4 ends in a round opening 5, 6, by means of which it is prevented that the slit tears even under strong, repeated strain.

Figure 2:
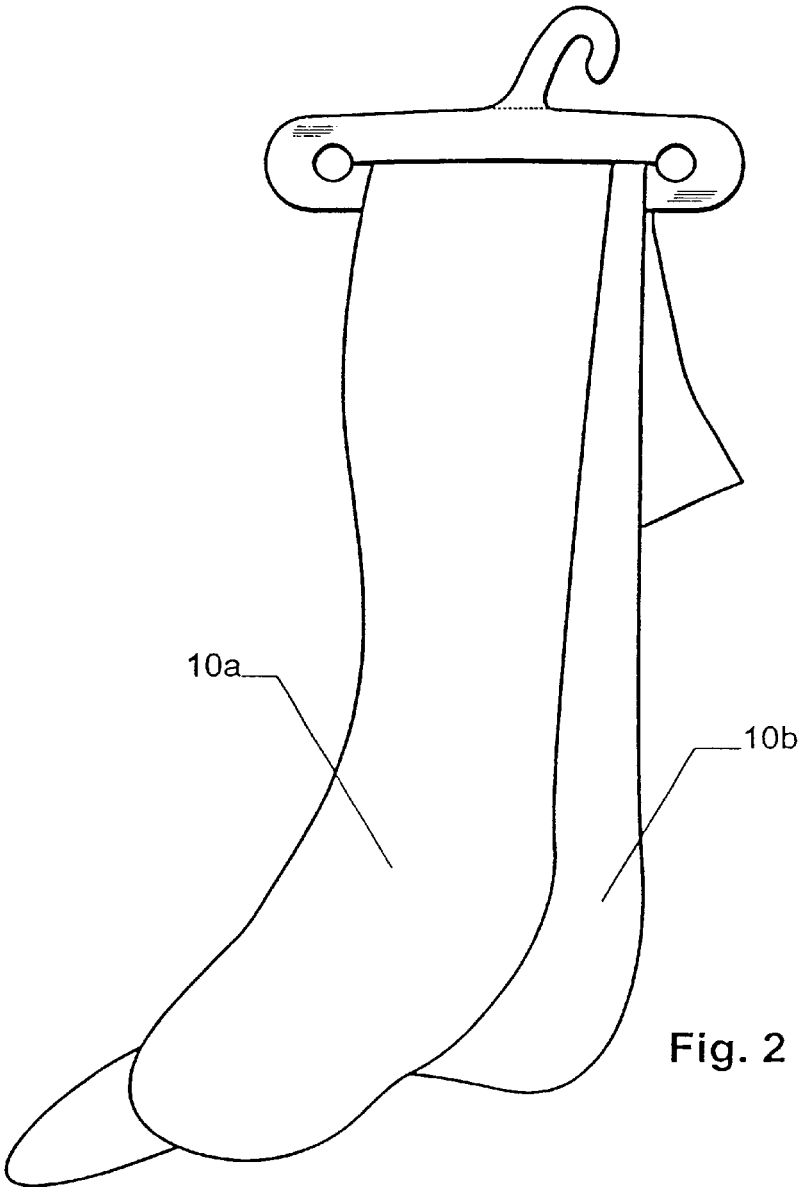
FIG. 2 the device of FIG. 1 with two socks held therein.

The holding body 1 forms along each side of the slit 4 a flexible frame 7, 8 of a width of approx. 5 to 15 mm. Due to the flexibility of this frame the slit 4 can be widened in order to receive two socks 10*a*, 10*b* as shown in FIG. 2.

The width of the slit 4 should be less than 3 mm, preferably less than 1 mm in order to guarantee a good retention even for thinner socks. As the slit runs substantially straight and comprises no teeth or corners, it softly holds the socks and damages are prevented.

The length of the slit can be matched to the socks' size, i.e. it is possible to provide e.g. special devices with short slits for children's socks.

The inventive device can be used for storing socks (e.g. in a salesroom) as well as washing and drying socks or stockings.

By using the device when washing the socks, it can be prevented that pairs of socks will be separated. Due to the softness and flexibility of Teflon, a damage of the washing machine or tumbler is prevented.

In particular when the device is only used for washing socks, the hook 2 can be removed. It is also possible, to produce devices for washing socks according to the invention without the hook 2.

As already mentioned, the device can be produced from a punched Teflon plate of constant thickness (preferably approx. 1.5 mm). However it is also possible, to produce it by injection molding. In this case, strongly stressed parts, such as the hook 2 or, where applicable one or both parts 7, 8 of the frame, can be reinforced with ribs.

The device is produced quickly and easily and is robust because it has no locks or springs, as they can usually be found in clamps. It is lightweight, which is of particularly advantage in the washing machine. It is suited for socks, stockings and others textiles used in pairs.

While preferred embodiments of the invention are described in the present application, it must be distinctly pointed out that the invention is not restricted thereto and can also be carried out in an other way within the scope of the following claims.

What is claimed is:

1. A device for holding socks or stockings in pairs, wherein the device is of washable, flexible material and comprises a holding body for holding two socks, wherein a slit is arranged in the holding body for receiving both socks, wherein the slit is enclosed on all sides by the holding body in non-openable manner and is substantially straight and without corners.

2. The device of claim 1, wherein the slit has a width of less than 3 mm.

3. The device of claim 1, wherein the holding body is an elongated, flexible plate, wherein the slit extends in longitudinal direction of the plate.

4. The device of claim 1, wherein the plate forms on every side of the slit a flexible frame of 5–15 mm width.

5. The device of claim 1, wherein the holding body has a thickness of 1.0–2.5 mm.

6. The device of claim 1, wherein the device is a single Teflon piece.

7. The device of claim 1, wherein it consists of a plastic plate of substantially constant thickness.

8. The device of claim 1, wherein it comprises a hook for hanging up the device.

9. The device of claim 8, wherein the hook is joined via a predetermined breaking point, in particular a perforation, with the holding body.

10. The device of claim 1, wherein the slit ends on each side in a round opening.

11. The device of claim 1, wherein it comprises exactly one slit.

12. The device of claim 2, wherein the slit has a width of less than 1 mm.

13. The device of claim 5, wherein the holding body has a thickness of approximately 1.5 mm.

14. A device for holding socks or stockings in pairs, wherein the device is of washable, flexible material and comprises:

a holding body for holding two socks, and a substantially straight slit arranged in said holding body for receiving the socks extending there through, wherein the slit is enclosed on all sides by the holding body in non-openable manner.

* * * * *